US010932057B2

(12) United States Patent
Zhang

(10) Patent No.: US 10,932,057 B2
(45) Date of Patent: Feb. 23, 2021

(54) SPEAKER

(71) Applicant: AAC Technologies Pte. Ltd., Singapore (SG)

(72) Inventor: Guqing Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/528,662

(22) Filed: Aug. 1, 2019

(65) Prior Publication Data

US 2020/0045473 A1 Feb. 6, 2020

(30) Foreign Application Priority Data

Aug. 5, 2018 (CN) ..... 2018 2 1252583 U
Aug. 5, 2018 (CN) ..... 2018 2 1255963 U

(51) Int. Cl.
*H04R 9/06* (2006.01)
*H04R 9/04* (2006.01)
*H04R 7/18* (2006.01)

(52) U.S. Cl.
CPC ..... *H04R 9/06* (2013.01); *H04R 7/18* (2013.01); *H04R 9/046* (2013.01); *H04R 2400/11* (2013.01); *H04R 2499/11* (2013.01)

(58) Field of Classification Search
CPC ... H04R 7/00; H04R 7/02; H04R 7/16; H04R 7/18; H04R 7/22; H04R 7/24; H04R 9/00; H04R 9/02; H04R 9/025; H04R 9/04; H04R 9/043; H04R 9/06; H04R 2207/021; H04R 2209/024; H04R 2499/00; H04R 2499/01
See application file for complete search history.

(56) References Cited

U.S. PATENT DOCUMENTS

2010/0316249 A1* 12/2010 Kamimura ..... H04R 9/043 381/399
2017/0366900 A1* 12/2017 Linghu ..... H04R 31/003

FOREIGN PATENT DOCUMENTS

WO WO-2016101722 A1 * 6/2016 ..... H04R 9/06

* cited by examiner

*Primary Examiner* — Walter F Briney, III
(74) *Attorney, Agent, or Firm* — W&G Law Group LLP

(57) ABSTRACT

The present disclosure provides a speaker, including a flexible circuit board, a holder, a diaphragm received in the holder, and a voice coil received in the holder and configured to drive the diaphragm to vibrate. The voice coil is electrically connected to the flexible circuit board, and includes an upper surface close to the diaphragm, a lower surface facing away from the diaphragm, and a side surface connecting the upper surface with the lower surface. The flexible circuit board includes a body portion supporting the voice coil. The body portion includes a bottom wall that abuts against the lower surface of the voice coil and an extension portion extending from the bottom wall while being bent towards the diaphragm. The extension portion is attached to and fixed to the side surface.

8 Claims, 7 Drawing Sheets

SPEAKER

TECHNICAL FIELD

The present disclosure relates to the field of electroacoustic transduction, and in particular, to a speaker.

BACKGROUND

A flexible printed circuit board (FPC board for short) is manufactured by adopting an insulating substrate such as a flexible polyester film or polyimide and combining the line formed on a copper foil by etching, and has high reliability and excellent flexibility. It can be freely bent, wound and folded, and can be arranged according to the spatial layout requirements and arbitrarily move and expand and contract in three-dimensional space, so as to achieve the integration of component assembly and wire connection. The use of the FPC board can greatly reduce a volume of a speaker, and is suitable for the development of the speaker in the direction of high density, miniaturization, and high reliability. Therefore, FPC boards have been widely used in aerospace, military, mobile communications, laptop computers, computer peripherals, handheld computers, digital cameras and other fields or products.

In the related art, a flexible circuit board is electrically connected to a voice coil. When the speaker is in operation, if the amplitude is too large when the voice coil swings with a diaphragm, a disconnection will appear between the flexible circuit board and the voice coil.

Therefore, it is necessary to provide a new speaker.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

Figure 1:
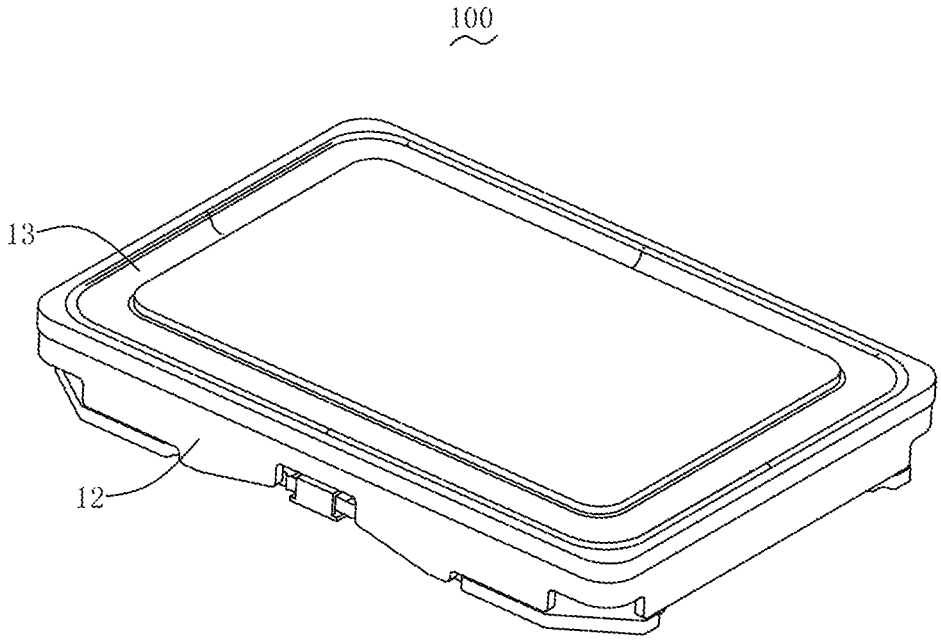
FIG. 1 is a perspective structural schematic diagram of a speaker of the present disclosure.
Figure 2:
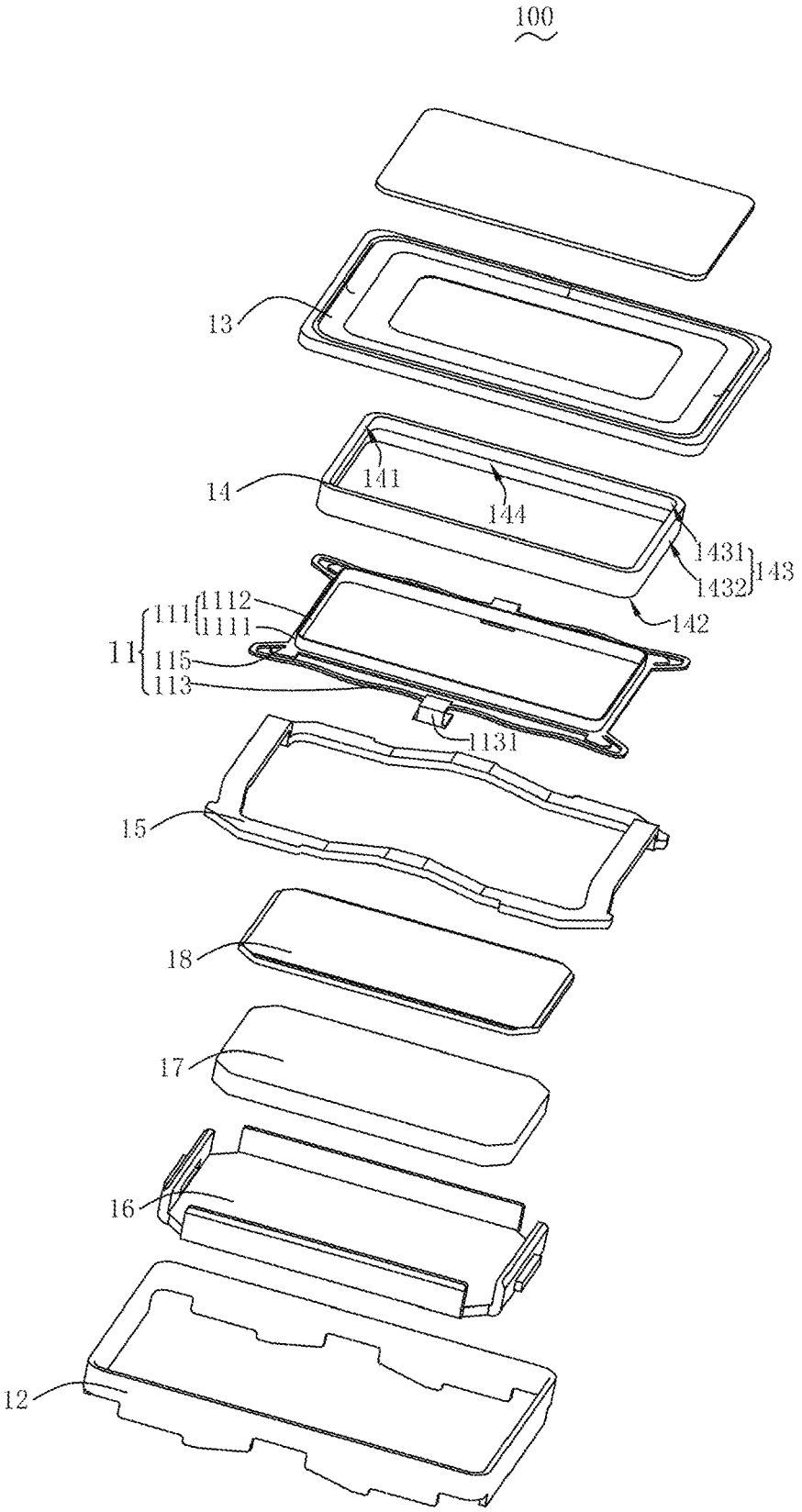
FIG. 2 is a perspective exploded schematic diagram of a first embodiment of a speaker of the present disclosure.
Figure 3:
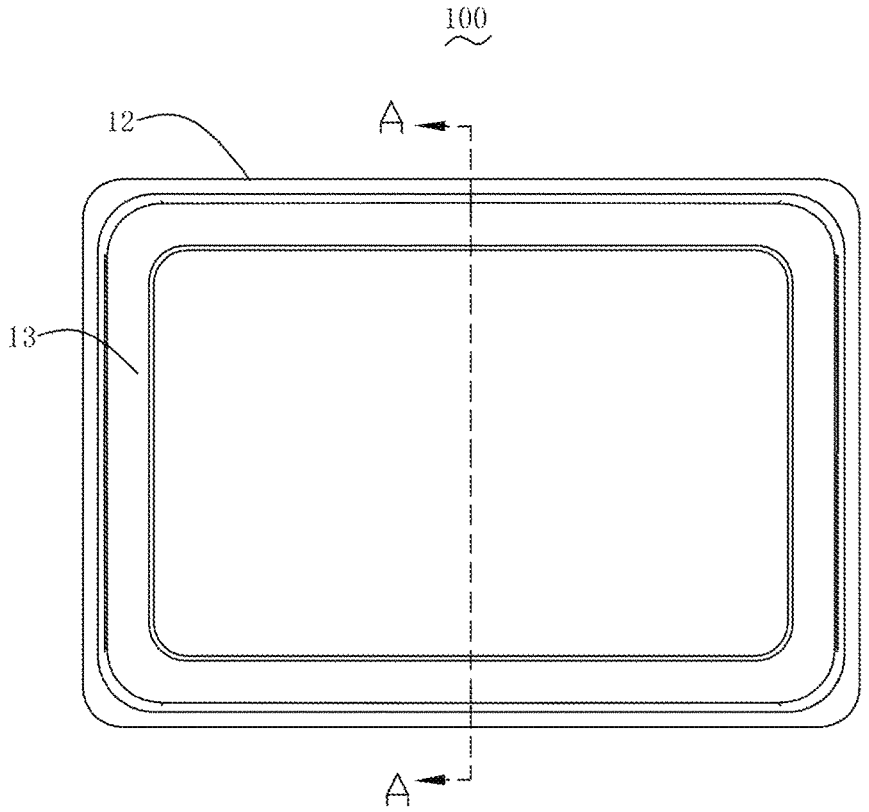
FIG. 3 is a plane structural schematic diagram of the first embodiment of a speaker of the present disclosure.

The present disclosure will be further illustrated with reference to the accompanying drawings and the embodiments.

The present disclosure provides a speaker 100. The speaker 100 of the present disclosure has different forms in different embodiments, as described next.

Embodiment 1

As shown in FIG. 1 to FIG. 5, in the first embodiment of the present disclosure, the speaker 100 includes a flexible circuit board 11, a holder 12, a diaphragm 13 received in the holder 12, and a voice coil 14 received in the holder 12 for driving the diaphragm 13 to vibrate. The voice coil 14 is electrically connected to the flexible circuit board 11. The voice coil 14 includes an upper surface 141 close to the diaphragm 13, a lower surface 142 facing away from the diaphragm 13, and a side surface 143 connecting the upper surface 141 with the lower surface 142. The side surface 143 includes an inner surface 1431 close to a center of the voice coil 14 and an outer surface 1432 corresponding to the inner surface 1431. Specifically, the flexible circuit board 11 includes a body portion 111 that supports the voice coil 14. The body portion 111 includes a bottom wall 1111 that abuts against the lower surface 142 of the voice coil 14, and an extension portion 1112 extending from an inner edge end of the bottom wall 1111 while being bent towards the diaphragm 13. The inner edge end of the bottom wall 1111 is an end of the bottom wall 1111 close to a center of the flexible circuit board 11. The extension portion 1112 abuts against the inner surface 1431 of the voice coil 14.

Figure 4:
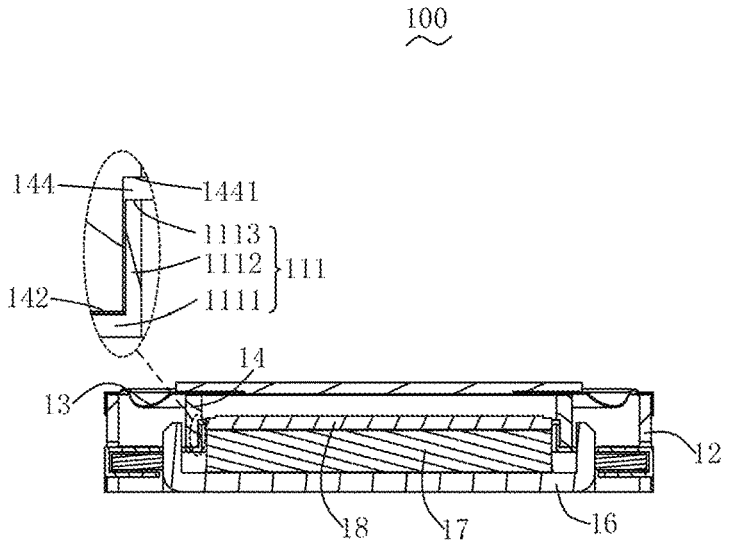
FIG. 4 is a cross-sectional structural schematic diagram taken along line A-A of FIG. 3.
Figure 5:
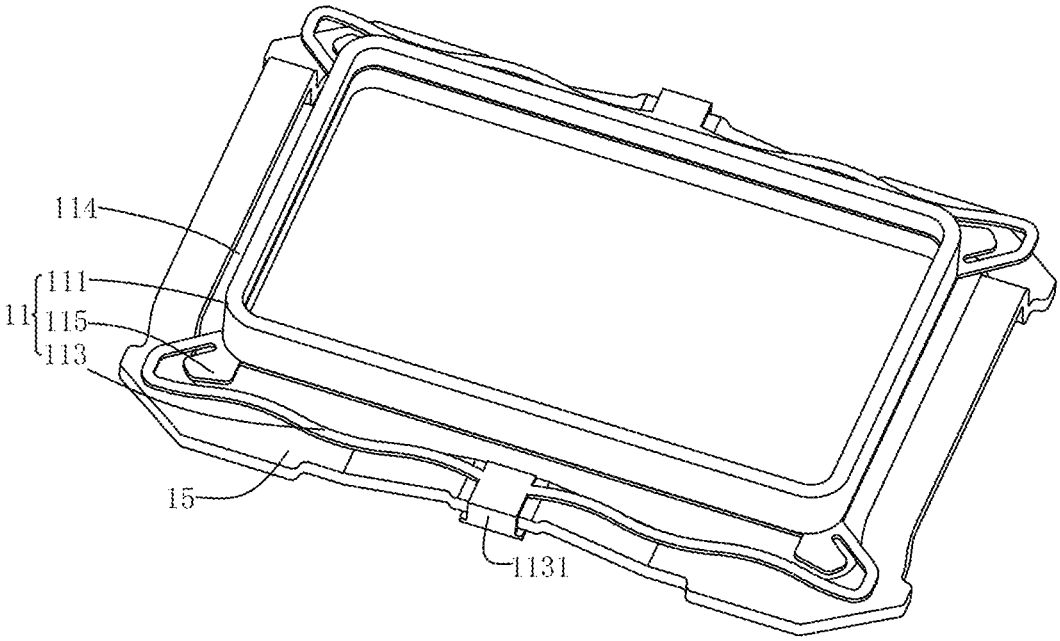
FIG. 5 is a partial structural schematic diagram of the first embodiment of a speaker of the present disclosure.
Figure 6:
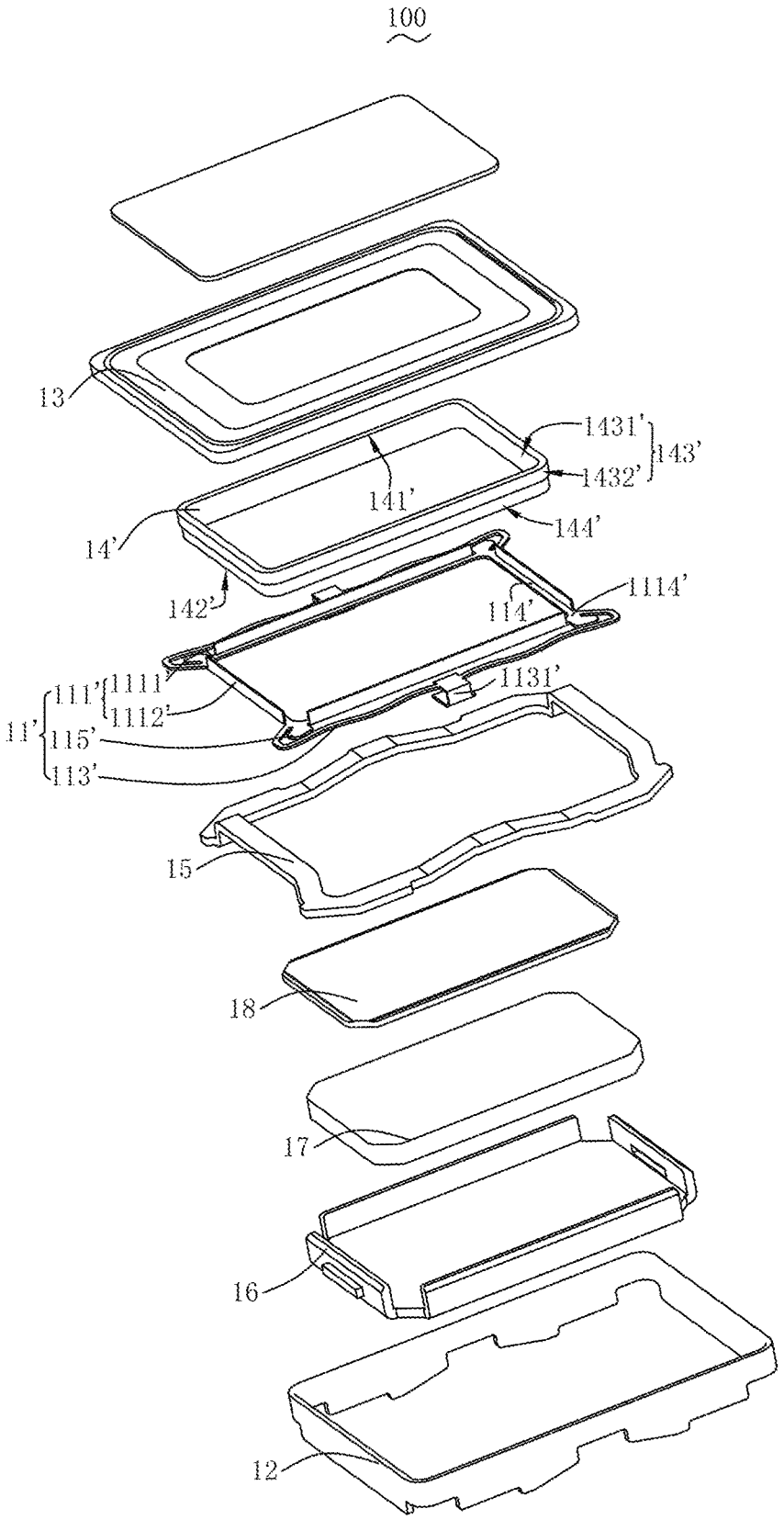
FIG. 6 is a perspective exploded schematic diagram of a second embodiment of a speaker of the present disclosure.
Figure 7:
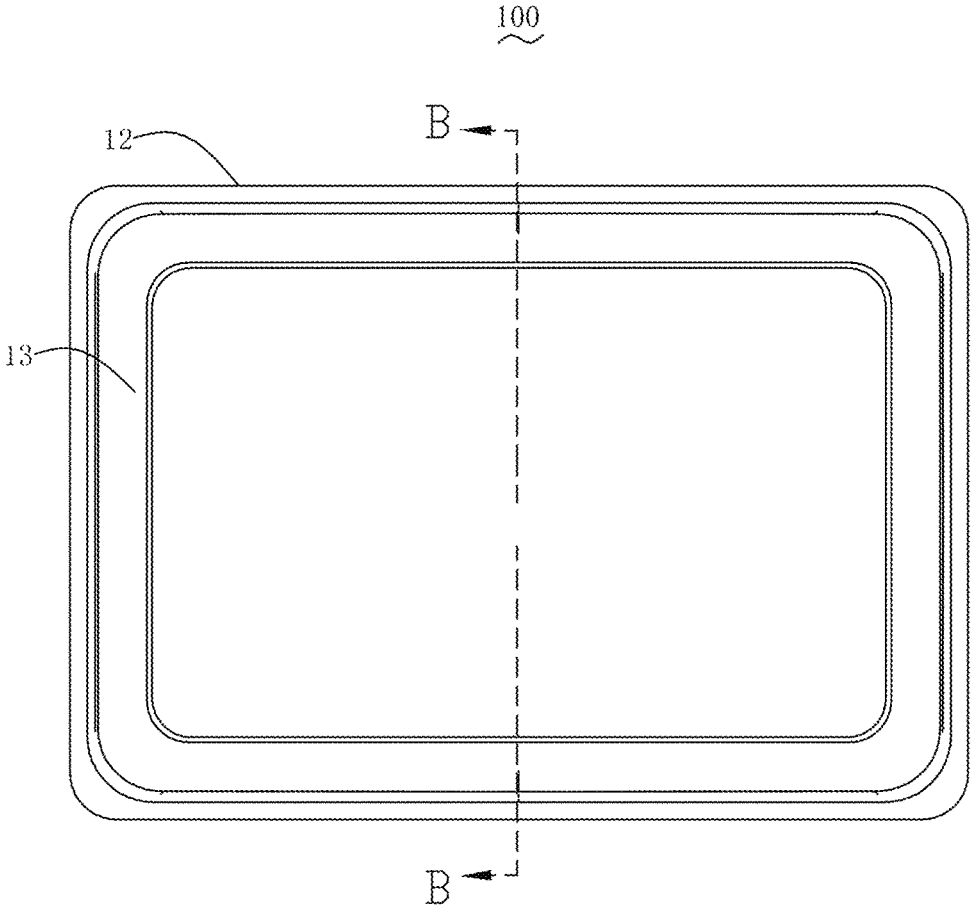
FIG. 7 is a plane structural schematic diagram of the second embodiment of a speaker of the present disclosure.

As shown in FIG. 4 and FIG. 5, in the present embodiment, the voice coil 14 includes a first receiving recess 144 that is recessed from the inner surface 1431 towards the outer surface 1432 of the voice coil 14. The first receiving recess 144 is connected to the lower surface 142 of the voice coil 14, and the extension portion 1112 of the flexible circuit board 11 is located in the first receiving recess 144. The voice coil 14 includes two long axis sides and two short axis sides. The flexible circuit board 11 is further provided with a connecting arm 113 located outside the long axis side of the voice coil 14, and the connecting arm 113 is connected to the body portion 111. The speaker 100 is further provided with a conductive ring 15 connected to an end of the holder 12 facing away from the diaphragm 13, and the connecting arm 113 is provided with a fixing slot 1131 that fixedly connects the conductive ring 15 with the flexible circuit board 11. The flexible circuit board 11 is also provided with a pad portion 115 that extends outwardly from the body portion 111.

As can be seen from FIG. 1, FIG. 4 and FIG. 5, the extension portion 1112 is a hollow annular structure. The extension portion 1112 and the bottom wall 1111 form a receiving portion 114. The receiving portion 114 of the flexible circuit board 11 wraps the voice coil 14 in a step manner to form an L-shaped matching structure. The extension portion 1112 includes a first planar surface 1113 facing towards the diaphragm 13. The voice coil 14 includes a second planar surface 1441, facing towards the extension portion 1112 of the flexible circuit board 11, on which a receiving recess 144 is formed. The first planar surface 1113 is spaced apart from the second planar surface 1441 to facilitate assembly of the flexible circuit board 11 and the voice coil 14 and may receive the glue that overflows when the flexible circuit board 11 is being attached to the voice coil 14.

Further, the first receiving recess 144 is also a continuous annular structure, as shown in FIG. 4 and FIG. 5. The first receiving recess 144 is a step portion formed by reducing the thickness of the voice coil along an inner peripheral wall inside the voice coil 14. The extension portion 1112 is inserted into the first receiving recess 144, and a lower end surface of the voice coil 14 is attached to the bottom wall 1111 to form an L-shaped matching structure (forming a structure in which the lower end of the voice coil 14 wraps the extension portion 1112 in a step manner), such that the extension portion 1112 matches and is fixed to the first receiving recess 144. The voice coil 14 is fixedly connected to the flexible circuit board 11 by a glue. Specifically, the extension portion 1112 and the voice coil 14 are attached together by a glue.

In addition, the speaker 100 is further provided with a magnetic circuit unit received in the holder 12. The magnetic circuit unit includes a magnetic frame 16, a magnet 17 provided at the magnetic frame 16, and a pole plate 18 stacked on the magnet 17.

In the present embodiment, the first receiving recess 144 of the voice coil 14 and the extension portion 1112 of the flexible circuit board 11 form a tongue-and-groove connection structure, which can increase the bonding strength of the voice coil 14 and the flexible circuit board 11, improve the voice coil swinging and disconnection reliability during the operation of the speaker, and increase the maximum amplitude. Moreover, the original magnetic gap size will not be affected, and thus the sound production performance of the speaker will not be affected.

Embodiment 2

As shown in FIG. 1, FIG. 6 to FIG. 9, it is the second embodiment of the present disclosure. The difference between Embodiment 2 and Embodiment 1 only lies in an extension portion 1112' extending from an outer edge end of a bottom wall 1111' while being bent towards a diaphragm 13'. The outer edge end of the bottom wall 1111' is an end of the bottom wall 1111' facing away from a center of the flexible circuit board 11'. The extension portion 1112' abuts against an outer surface 1432' of the voice coil 14'.

Figure 8:
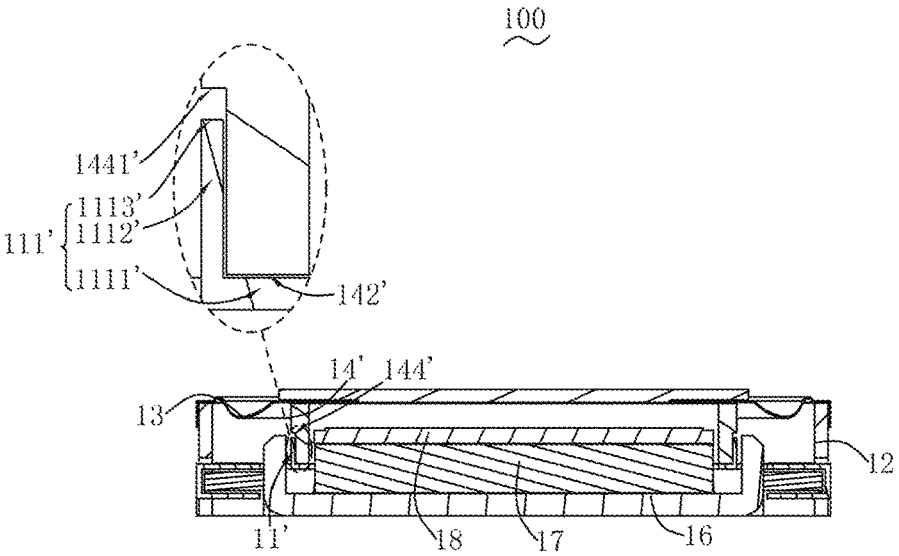
FIG. 8 is a cross-sectional structural schematic diagram taken along line B-B of FIG. 7.
Figure 9:
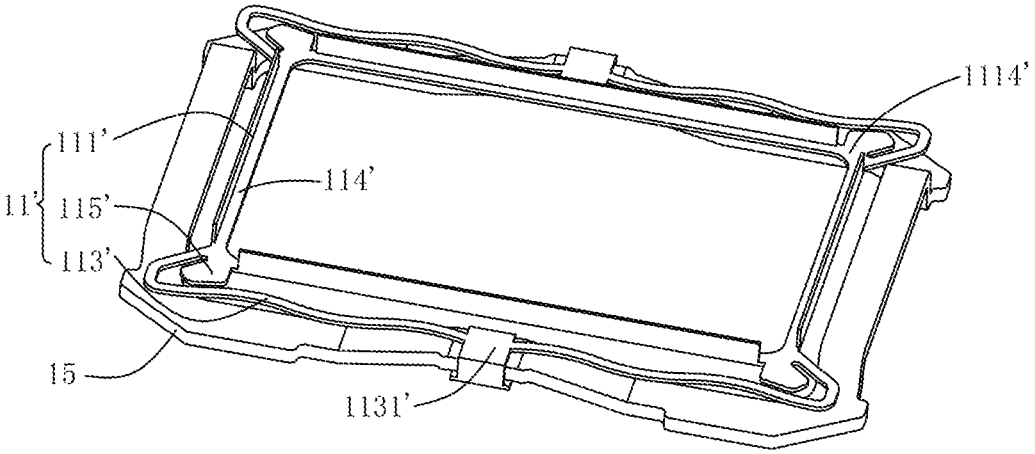
FIG. 9 is a partial structural schematic diagram of the second embodiment of a speaker of the present disclosure.

As shown in FIGS. 8 and 9, in the present embodiment, the voice coil 14' includes a second receiving recess 144' recessed from the outer surface 1432' towards the inner surface 1431' of the voice coil 14'. The second receiving recess 144' is connected to a lower surface 142' of the voice coil 14', and the extension portion 1112' of the flexible circuit board 11' is located in the second receiving recess 144'.

The extension portion 1112' includes a third planar surface 1113' facing towards the diaphragm 13'. The voice coil 14' includes a fourth planar surface 1441', facing towards the extension portion of the flexible circuit board 11', on which the second receiving recess 144' is formed. The third planar surface 1113' is spaced apart from the fourth planar surface 1441' to facilitate assembly of the flexible circuit board 11' with the voice coil 14' and may receive the glue that overflows when the flexible circuit board 11' is being attached to the voice coil 14'.

As shown in FIGS. 6 to 9, in the present embodiment, the voice coil 14' includes two long axis sides and two short axis sides connecting the long axis sides. The extension portion 1112' is provided with a discontinuous recess 1114' at a position where the long axis side and the short axis side are connected, so that the voice coil 14' is electrically connected to the flexible circuit board 11'. Compared with the related art, the speaker of the present disclosure, by attaching and fixing the extension portion of the flexible circuit board to the receiving recess of the voice coil, can increase the bonding strength between the voice coil and the flexible circuit board, significantly improve the voice coil swinging and disconnection reliability during the operation of the speaker and increase the maximum amplitude.

What has been described above is only an embodiment of the present disclosure, and it should be noted herein that one ordinary person skilled in the art can make improvements without departing from the inventive concept of the present disclosure, but these are all within the scope of the present disclosure.

What is claimed is:

1. A speaker, comprising:

a flexible circuit board;

a holder;

a diaphragm received in the holder; and a voice coil received in the holder and configured to drive the diaphragm to vibrate, the voice coil being electrically connected to the flexible circuit board and comprising an upper surface close to the diaphragm, a lower surface facing away from the diaphragm, and a side surface connecting the upper surface with the lower surface, the side surface comprising an inner surface close to a center of the voice coil and an outer surface corresponding to the inner surface, wherein the flexible circuit board comprises a body portion supporting the voice coil, the body portion comprising a bottom wall that abuts against the lower surface of the voice coil and an extension portion extending from the bottom wall while being bent towards the diaphragm, the extension portion being attached to and fixed to the side surface, the voice coil comprises two long axis sides and two short axis sides, the flexible circuit board being further provided with a connecting arm located outside the long axis sides of the voice coil, the connecting arm being connected to the body portion, wherein the speaker is further provided with a conductive ring connected to an end of the holder facing away from the diaphragm, the connecting arm being provided with a fixing slot, the fixing slot fixedly connecting the conductive ring to the flexible circuit board.

2. The speaker as described in claim 1, wherein the extension portion of the flexible circuit board extends from an inner edge end of the bottom wall of the flexible circuit board towards the diaphragm, and the extension portion of the flexible circuit board is attached to and fixed to the inner surface of the voice coil.

3. The speaker as described in claim 2, wherein the inner surface of the voice coil is provided with a first receiving recess recessed towards the outer surface of the voice coil, and the extension portion of the flexible circuit board is received in the first receiving recess.

4. The speaker as described in claim 3, wherein the extension portion of the flexible circuit board comprises a first planar surface facing towards the diaphragm, the voice coil comprising a second planar surface, facing towards the extension portion of the flexible circuit board, on which the first receiving recess is formed, the first planar surface being spaced apart from the second planar surface.

5. The speaker as described in claim 1, wherein the extension portion of the flexible circuit board extends from an outer edge end of the bottom wall of the flexible circuit board towards the diaphragm, and the extension portion of the flexible circuit board is attached to and fixed to the outer surface of the voice coil.

6. The speaker as described in claim 5, wherein the outer surface of the voice coil is provided with a second receiving recess recessed towards the inner surface of the voice coil, and the extension portion of the flexible circuit board is received in the second receiving recess.

7. The speaker as described in claim 6, wherein the extension portion of the flexible circuit board comprises a third planar surface facing towards the diaphragm, the voice coil comprises a fourth planar surface, facing towards the extension portion of the flexible circuit board, on which the second receiving recess is formed, and the third planar surface is spaced apart from the fourth planar surface.

8. The speaker as described in claim 7, wherein the voice coil comprises two long axis sides and two short axis sides connecting the two long axis sides, and the extension portion is provided with a discontinuous recess at a position where the two long axis sides and the two short axis side are connected.

* * * * *